US006173509B1

(12) United States Patent
Bowen

(10) Patent No.: US 6,173,509 B1
(45) Date of Patent: Jan. 16, 2001

(54) FLEXIBLE SECUREMENT MEANS FOR SECURING A DEVICE OR PARTS THEREOF TO FLAPS OF AN ASSOCIATED SHOE

(76) Inventor: Richard Bowen, 331 Varick St., Jersey City, NJ (US) 07302

( * ) Notice: Under 35 U.S.C. 154(b), the term of this patent shall be extended for 0 days.

(21) Appl. No.: 09/377,704

(22) Filed: Aug. 20, 1999

(51) Int. Cl.[7] ..... A43C 11/00; A43B 5/04

(52) U.S. Cl. ..... 36/50.1; 36/50.5; 24/712; 24/712.1

(58) Field of Search ..... 36/50.1, 50.5; 24/685 K, 695 K, 703 K, 715 K, 68 CD, 712.5, 713.6, 712, 712.1, 712.6

(56) References Cited

U.S. PATENT DOCUMENTS

| | | | | |
|---|---|---|---|---|
| 176,022 | * | 4/1876 | Marsh | 36/50.1 |
| 438,245 | * | 10/1890 | Seymour | 36/50.1 |
| 1,239,610 | * | 9/1917 | Loyland | 36/50.1 |
| 1,442,468 | * | 1/1923 | Cochrane | 36/50.1 |
| 1,678,241 | * | 7/1928 | Benz | 36/50.1 |
| 3,634,910 | * | 1/1972 | Keskari | 24/69 SK |
| 3,902,229 | | 9/1975 | Doerpinghaus . | |
| 4,428,099 | * | 1/1984 | Richmond | 24/68 CD |
| 4,541,147 | * | 9/1985 | Oliveri | 24/68 CD |
| 4,907,352 | | 3/1990 | Ginsberg . | |
| 5,259,094 | | 11/1993 | Zepeda . | |
| 5,526,585 | | 6/1996 | Brown et al. . | |
| 5,819,378 | * | 10/1998 | Doyle | 24/71 SK |
| 6,018,890 | * | 2/2000 | Bowen | 36/50.1 |
| 6,049,955 | * | 4/2000 | Bowen | 24/712 |

* cited by examiner

*Primary Examiner*—Paul T. Sewell
*Assistant Examiner*—Anthony Stashick

(57) ABSTRACT

A means to secure a device or parts thereof to the flaps of an associated shoe is flexible, and comprises a plurality of flap attachments which can be fixedly or detachably secured to the flap(s) of a shoe. Each flap attachment is attached directly or via intermediate attachments to an elongate member which is securable to the device. Each intermediate attachment has two ends, one secured to the flap attachment and the other to the elongate member. The elongate member can be longitudinally extendable and retractable and can be made up of shorter segments connected to each other. The flap attachments are pivotably secured to one another in a linear sequence where at least one segment is attached directly or indirectly to the device. One type of flap attachment is permanently secured to the shoe by methods like adhesive bonding and fasteners. Another is detachable from the shoe and consists of three versions. The first version has a peg-like structure placed through an eyelet of the flap and confines a portion of the flap between surfaces. The second version consists of a small elongate member, with two ends, inserted in a loop, where the loop itself is secured to the flap. Each end is securable to a support completing a closed circuit confining loop. The third version has the terminal end of a peg-like structure pinning a portion of a flap against one surface when the peg-like structure engages an opening in a proximal surface.

17 Claims, 16 Drawing Sheets

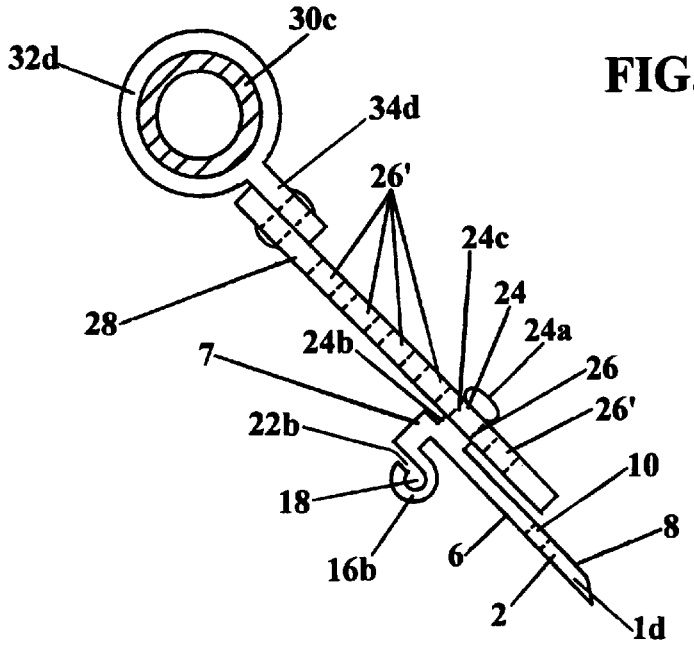
FIG. 6
FIG. 7
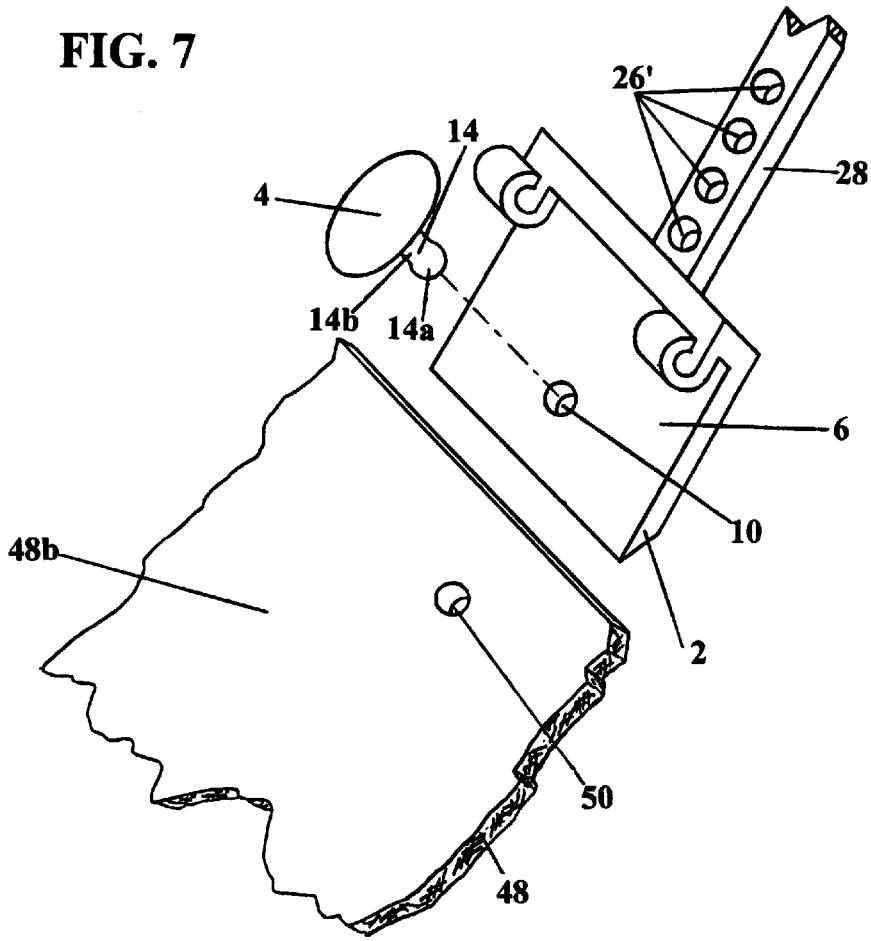

FLEXIBLE SECUREMENT MEANS FOR SECURING A DEVICE OR PARTS THEREOF TO FLAPS OF AN ASSOCIATED SHOE

BACKGROUND

1. Field of Invention

This contribution to the art is related to the field encompassing means for securing devices to a shoe and is geared in particular to providing flexible means to secure a variety of shoe fastening and other devices to flaps of a shoe constructed with dual flaps on opposing sides of a tongue.

BACKGROUND

2. Discussion of Prior Art

The flap portions of a conventional shoe constructed with dual flaps on opposing sides of a tongue are by design the user operative portion of said shoe. These are the parts of the shoe that are fastened to secure the shoe onto the foot or unfastened to loosen shoe from foot or laterally spread apart to insert or remove foot from shoe. However since flap portions of shoes are mainly used in the fastening or unfastening of shoe onto foot the examples of devices employing use of said flaps portions will be geared mainly towards shoe fastening devices. A shoe is by design fastened by directing either one, but more usually both flaps towards each other, and thus virtually all shoe fastening devices for conventional shoes accomplish their task this way. Consequently whatever the device used to effect fastening it must be secured to the flaps in some way. The present contribution to the art is designed to provide flexible securement means that act as intermediary conduits through which the forces effecting fastening or unfastening of shoe from fastening device to flaps pass through, and where fastening devices and securement means work in unison with each other.

A number of securement means for shoe fastening devices have been described in prior art, and while these may be suitable for use with the particular shoe fastening device they were designed to be used with they would not be suitable for use with the range of fastening devices the present invention can be used with. For example, U.S. Pat. No. 5,526,585 describes an attachment device for use with a lace substitute hand actuable shoe closure system consisting of a buckle plate to which is attached either a peg or a hook and a corresponding opening for peg or hook. The buckle plate is designed to be used with a Velcro™ strap fastening system. Again U.S. Pat. No. 4,907,352 has an attachment mechanism designed to be used with Velcro™ straps, and as the title of U.S. Pat. No. 3,902,229 states, it is a fastening arrangement at the ends of two straps for the detachable connection thereof. Most of the attachment mechanisms which are novel and unobvious to someone having reasonable skill in the field seem to be geared to work mainly with strap fasteners. The present invention can be easily adapted to work in unison with all of the abovementioned strap fastening systems as well as most lacing systems and non strap fastening systems such as my patent application Ser. No. 09/126,478, patent application Ser. No. 09/206,122 and U.S. Pat. No. 5,259,094, as well as virtually any device which utilizes the flap portions of a conventional shoe to perform its function while providing flexibility and accommodating the twisting, shearing, and bending forces experienced by flaps of shoe especially during high activity use such as racquetball, hiking, dancing, and so on.

BACKGROUND

Objects and Advantages

As such one object of the of invention presented here is to provide flexible securement means for securing a variety of devices or parts thereof to the flap portion(s) of an associated shoe.

Another object of the invention presented here is to provide a flexible securement means which can be easily adapted to be integrated with and work in unison with virtually any device incorporating use of the flaps of shoe.

Yet another object of the of invention presented here is to provide a flexible securement means that can be adapted to be easily attached to and detached from a variety flaps including flaps containing regular or annular eyelets or loops or flaps containing neither as well as being permanently secured to said flaps.

A further object of the of invention presented here is to provide a flexible, securement means that is flexible enough to accommodate irregular twisting or bending of shoe especially during high activity use such as dancing, racquetball, and so on in the same or better manner than that achieved by laces.

A yet further object of the of invention presented here is to provide a flexible securement means which is durable in construction and can last the life of a conventional shoe.

An even further object of the invention presented here is to provide a flexible, securement means which can be easily and cost effectively manufactured either by itself and adapted to be used with a variety of corresponding fastening devices or as an integral with a shoe fastening device.

These together with other objects of the invention along with features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated varying embodiments of the invention.

BRIEF DESCRIPTION OF THE DRAWINGS

FIG. 6 is a profile of one part of the flap attachment means 1*d* of first embodiment of securement means secured to secondary elongate member 30*c* via intermediate attachment means 28 and bearing 32*d*.

FIGS. 7 and 8 are isometric views of a flap 48 about to be secured to a flap attachment means of the first embodiment and secured to said flap attachment means by the eyelet engagement method respectively.

DESCRIPTION OF FIRST EMBODIMENT OF SECUREMENT MEANS

In FIGS. 1, 2, 3 and 4 a pair of symmetrical securement means are shown. Since both securement means are symmetrical, focus will be given to one only with the understanding that the other symmetrical securement means operates in exactly the same manner as the one being described. The one being described will be the one on the right in FIG. 1. Also for present purposes it is assumed that the securement means or at least detachably engageable parts thereof are made out of resilient material.

Figure 1:
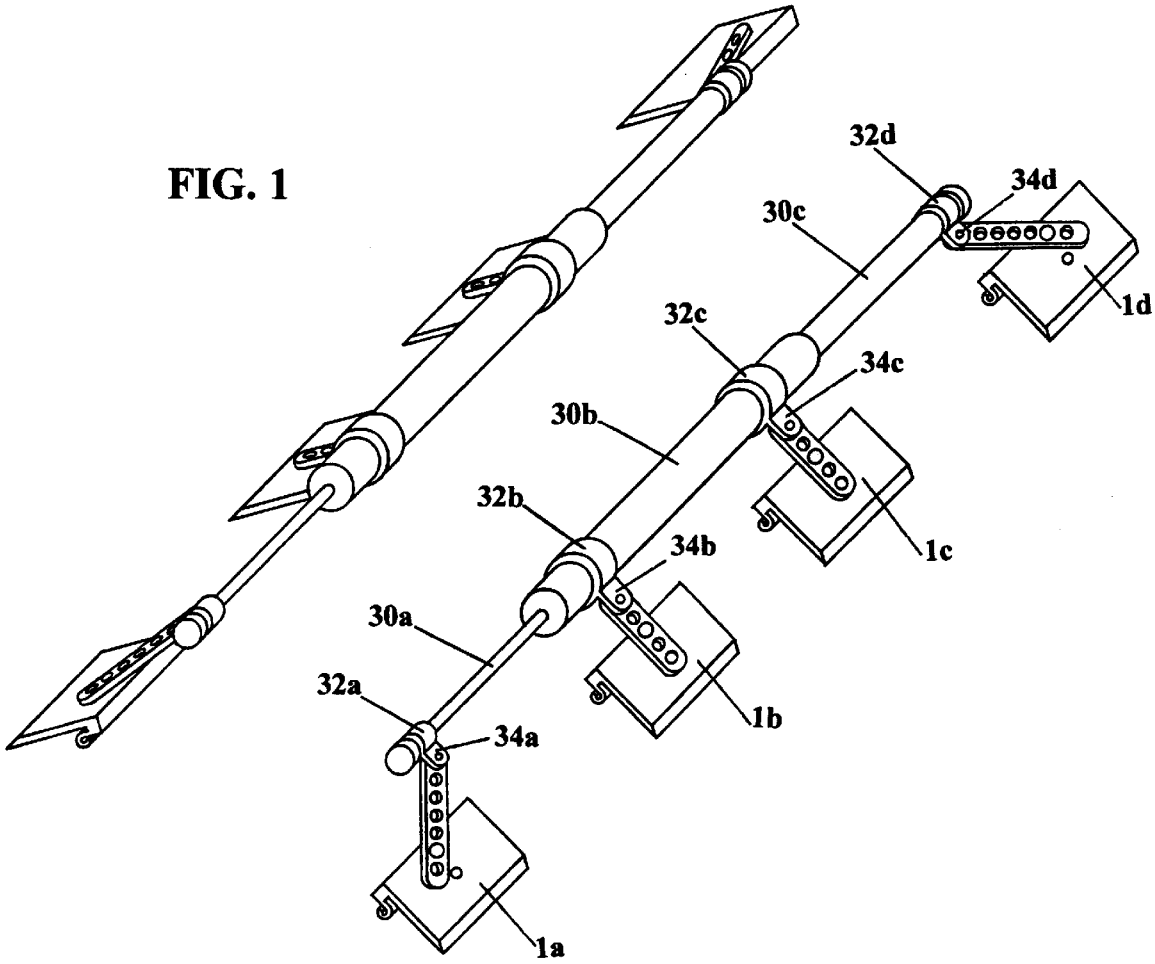
FIG. 1 is an isometric view of a symmetrical pair of first embodiment of securement means.
Figure 9:
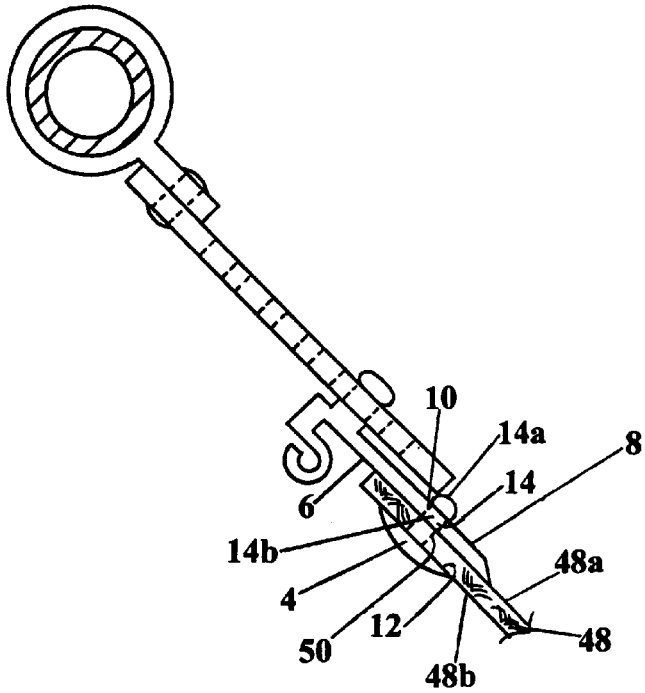
FIG. 9 is a profile view of flap 48 being attached to flap attachment means of the first embodiment by the eyelet engagement method.
Figure 10:
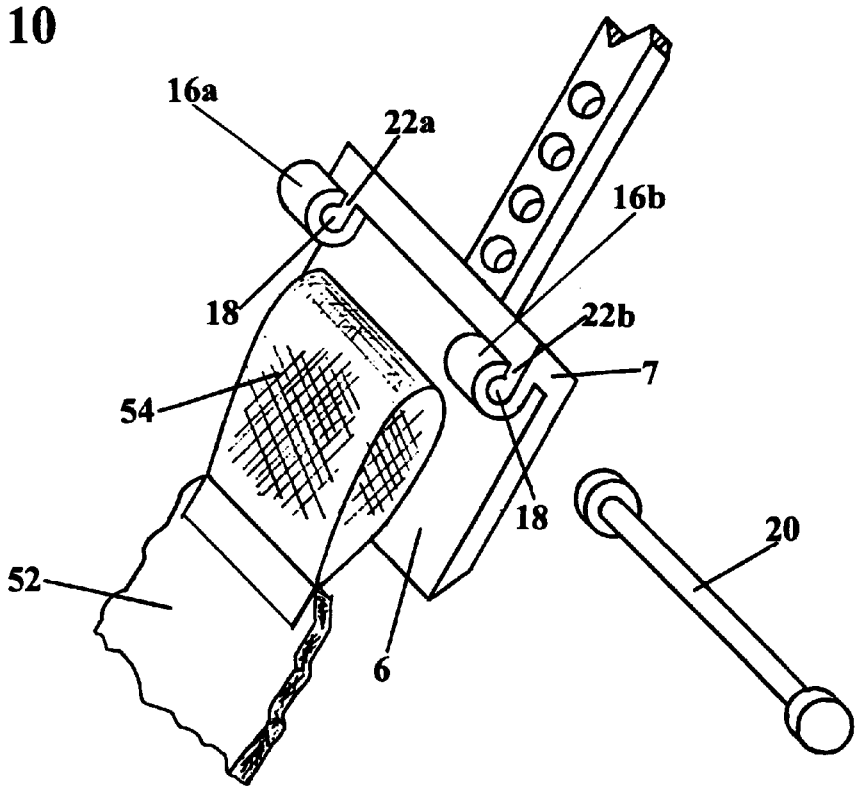
FIGS. 10 and 11 are isometric views of a flap 52 with loop 54 about to be secured to a flap attachment means of the first embodiment and secured to said flap attachment means by the loop engagement method respectively.
Figure 11:
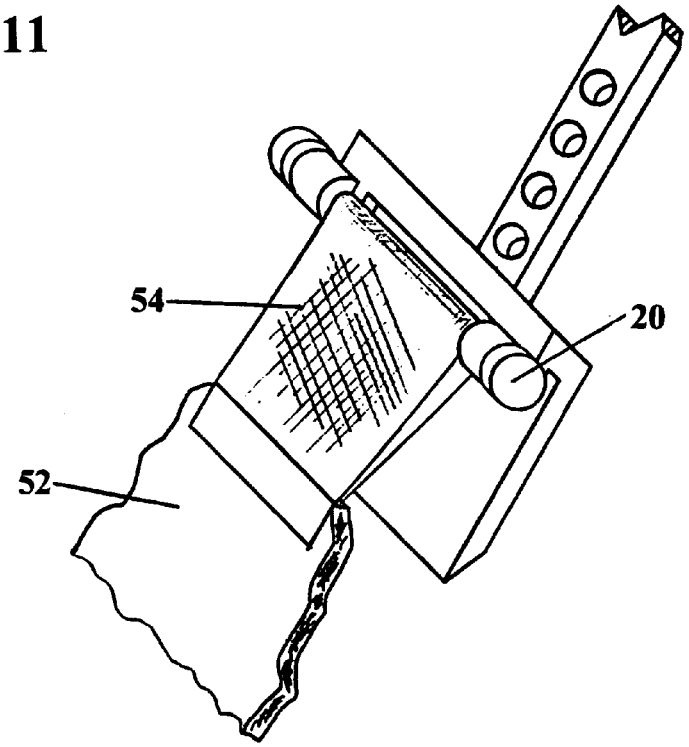
Figure 12:
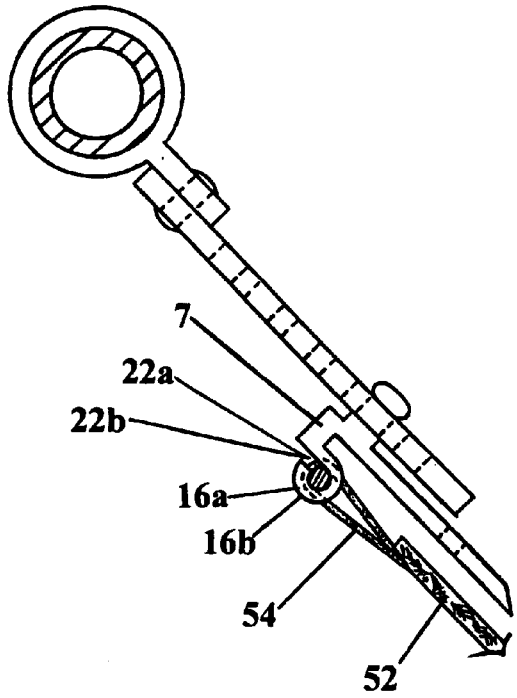
FIG. 12 is a profile view of flap 52 being attached to flap attachment means of the first embodiment by the loop engagement method.
Figure 14:
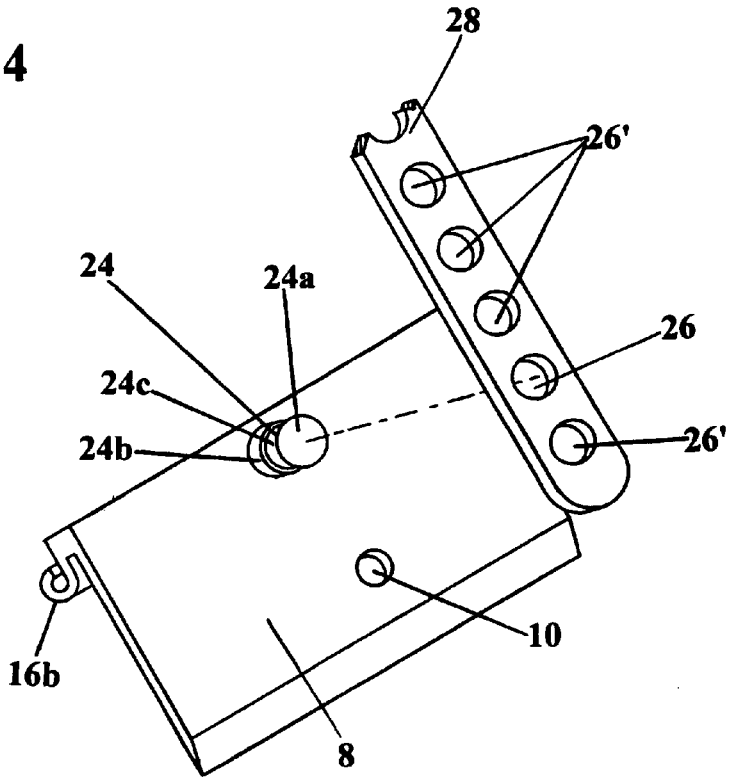
FIGS. 14 and 15 are isometric views of flap attachment means 1*d* about to be attached to its respective intermediate attachment means and said flap attachment means secured to its respective intermediate attachment means with intermediate attachment means pivoting about secondary elongate member 30*c* to which it is secured respectively.

The first embodiment of the securement means shown in FIG. 1 comprises a plurality of flap attachment means, 1*a,* 1*b,* 1*c,* and 1*d.* Each flap attachment means comprises three separate members 2, 4, and 20 as seen in FIGS. 7 and 10. Member 2 is fundamentally a rectangular shaped planar segment with two planar surfaces 6 and 8 with a circular cross-sectional opening 10 located in it as illustrated in FIGS. 6, 7, and 9. Member 4 is similar to a thumb tack in its overall shape and has a planar surface 12 with a cylindrical peg like eyelet engagement means 14 extending from said surface 12 for inserting into 10 which can be seen in FIGS. 7, and 9. Member 20 which hereafter is referred to as a loop engagement means will be described shortly. On member 4 however, the peg like eyelet engagement means 14 has a spherically shaped terminal end 14*a* with a larger trans-axial diameter than that of its shaft 14*b,* and where the diameter of shaft 14*b* is wide enough so as to allow 14*b* to just fit into 10. However due to its larger diameter 14*a* cannot easily fit into opening 10 and does so only when instantaneously passing through 10 which is achieved by the application of a steady compressing or separating force resulting in a snapped engagement or detachment respectively of 14 with 10, and as such terminal end 14*a* always tends to be confined to one of the planar sides of 2. Secured to one of the planar surfaces 6 of member 2 via an interim portion 7 are two bearing like support means 16*a* and 16*b* that can be described as similar and co axial sections of a pipe having uniform throughbore 18 and that are laterally set apart and parallel to the upper and lower sides of 2 as shown in FIGS. 6 and 10. Support means 16*a* and 16*b* exist for supporting loop engagement means 20 which is a small elongate cylindrical element having capped ends as illustrated in FIGS. 10 and 11 and seen in FIG. 12. The diameter of 20 is wide enough to allow it to just fit securely in throughbore 18 which is accessible via two slots 22*a* and 22*b*, FIGS. 6 and 10. The diameter of 20 is too wide to allow it to easily fit into slots 22*a* and 22*b* and as such 20 fits into said slots only when instantaneously passing through them which is achieved by the application of a steady compressing or separating force resulting in a snapped engagement or detachment respectively of 20 with 16*a* and 16*b*, FIGS. 11, and 10 respectively. As seen in FIGS. 9 and 12, and as illustrated in FIGS. 6 and 14 secured to the planar surface 8 of member 2 is a peg like protuberance 24 comprising cylindrical base and shaft portions 24*b* and 24*c* respectively, and an ellipsoid shaped terminal end 24*a*. All three portions are coaxial with the base 24*b* and terminal end 24*a* portions having larger trans-axial diameters than that of shaft portion 24*c* and where the diameter of 24*c* is wide enough so as to allow 24*c* to just fit into one 26 of a series of openings 26' located in an intermediate attachment means 28 seen in FIGS. 6, 7, and 14 and which will be described in more detail shortly. However due to its larger diameter 24*a* cannot easily fit into 26 and does so only when instantaneously passing through 26 which is achieved by the application of a steady compressing or separating force resulting in a snapped engagement or detachment respectively of 24 with 26.

Figure 13:
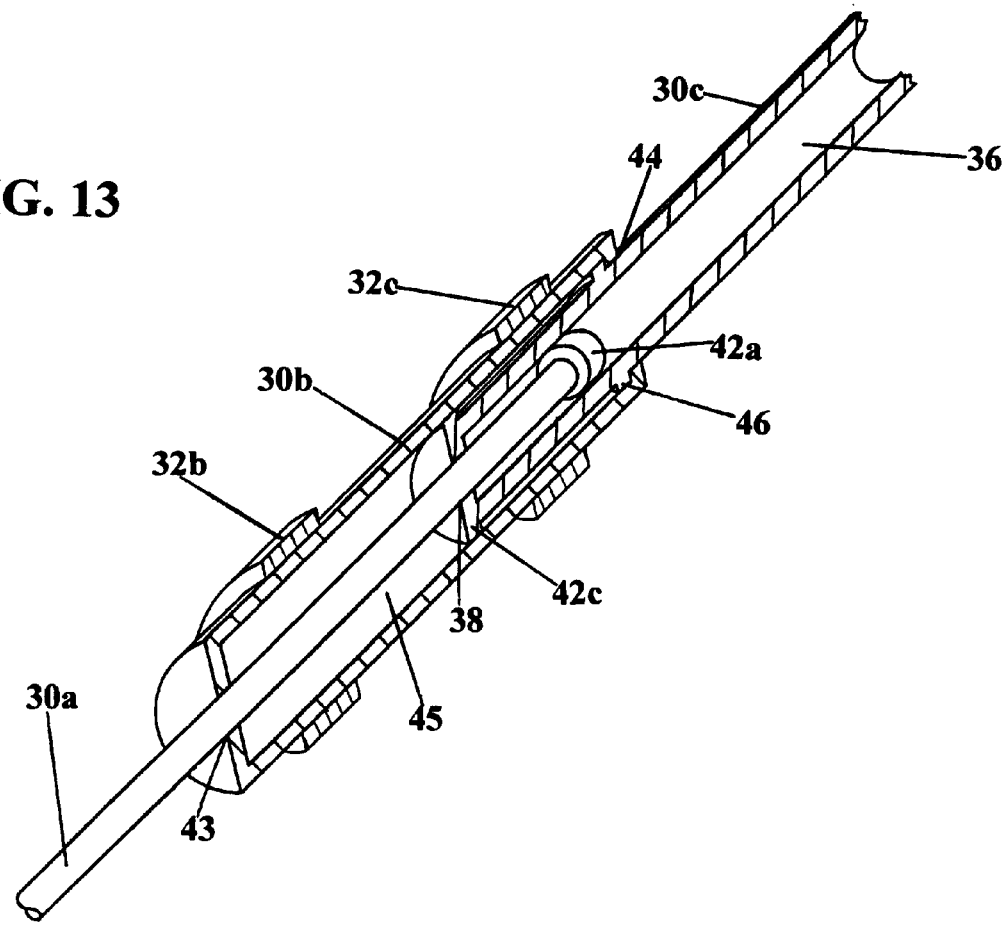
FIG. 13 is an isometric sectional of the elongate member exposing the longitudinally slidable secondary elongate members 30*a,* 30*b,* and 30*c.*
Figure 15:
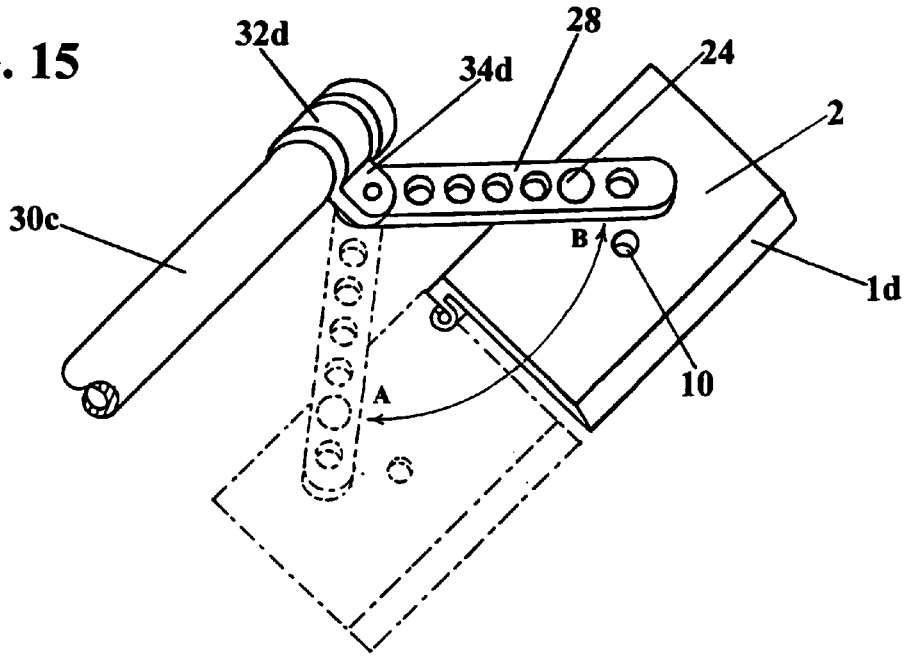
Figure 16:
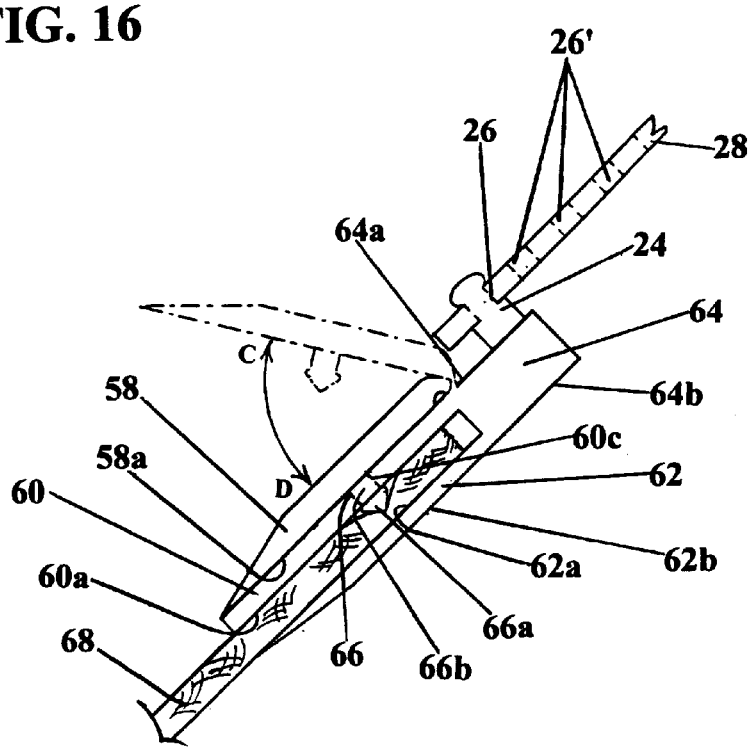
FIGS. 16, 17, 18, an 19 are respectively a profile of flap pinning method flap attachment means; an isometric of the same flap attachment means with the section of planar segment 62 removed; an isometric showing same flap attachment means about to be attached to its respective intermediate attachment means; and said flap attachment means secured to its respective intermediate attachment means with intermediate attachment means pivoting about secondary elongate member to which it is secured.
Figure 17:
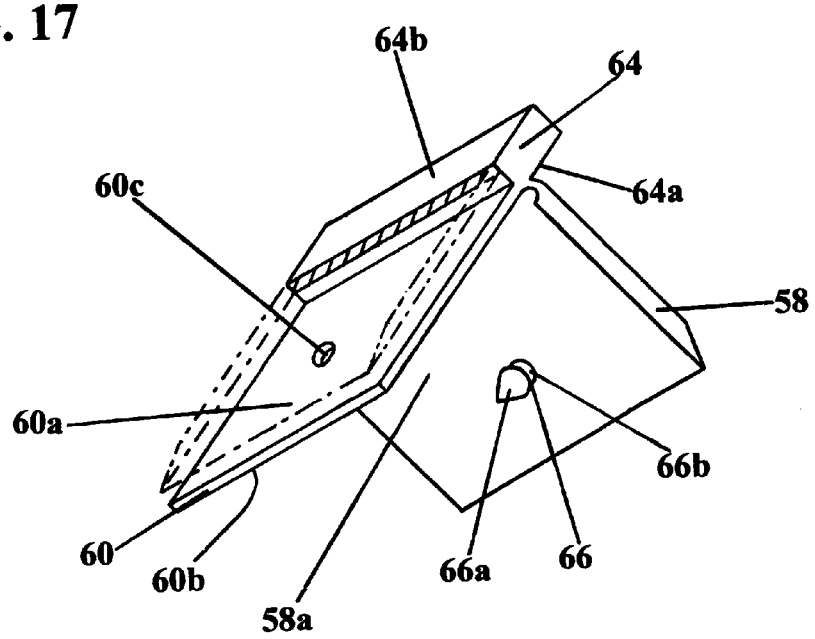
Figure 18:
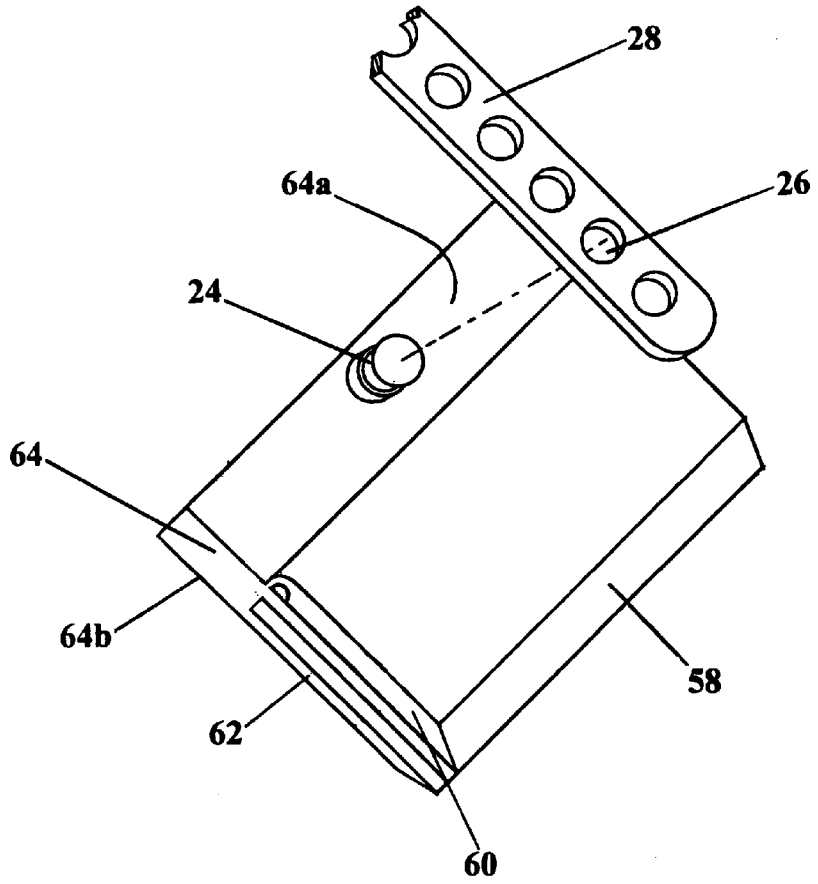
Figure 19:
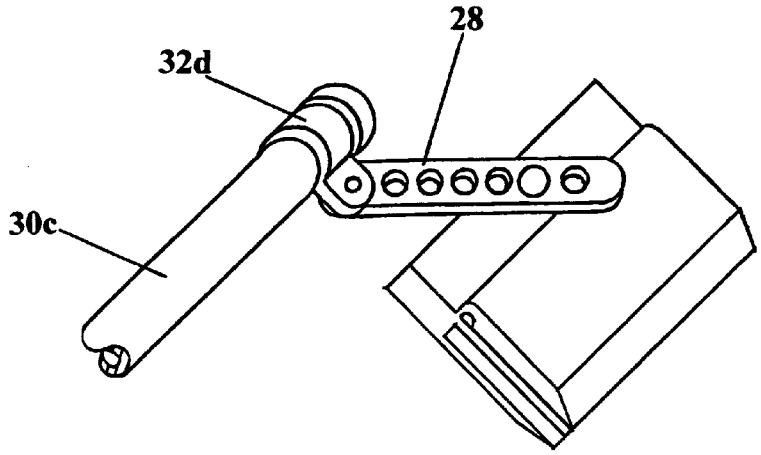

As seen in FIGS. 1 through 14 and as indicated in FIGS. 6, 7, and 14 the intermediate attachment means are narrow elongated planar members with a longitudinally arranged series of openings 26' for engaging the peg like protuberances 24 of flap attachment means. Each flap attachment means is securable to a respective intermediate attachment means via the engagement of its peg like protuberance 24 with an opening 26 in a respective intermediate attachment means 28, FIGS. 6 and 14. The secured flap attachment means can pivot from side to side in planes parallel to their respective intermediate attachment means and as such can maintain their orientation relative to a longitudinally extendable elongate member comprising three coaxial secondary and slidable elongate members 30*a*, 30*b*, and 30*c* even when the respective intermediate attachment means are rotated towards any of said coaxial secondary elongate members as can be seen in FIG. 15 between flap attachment means 1*d* and secondary elongate member 30*c*. The rotation of the intermediate attachment means is possible due to the fact that the intermediate attachment means are pivotably secured to four bearings 32*a*, 32*b*, 32*c*, and 32*d* as seen in FIG. 1 which are rotatable about and slidable along the longitudinal axis of the elongate member and which are essentially short pipe like elements each having a connective portion 34*a*, 34*b*, 34*c*, and 34*d* pivotally connecting to one end of a respective intermediate attachment means. Two of the bearings 32*b* and 32*c* are located on a shaft of 30*b* which is one of the three coaxial secondary elongate members of which the elongate member comprises, and one bearing each 32*a* and 32*d* is located on the shafts of secondary elongate slidable members 30*a* and 30*d* respectively which are the other two coaxial secondary elongate members of which the elongate member comprises. Each of the bearings 32*a* through 32*d* has an inner diameter which allows it to rotate smoothly about and just slide along its respective shaft. All of the intermediate attachment means can pivot from side to side in planes parallel to that of the longitudinal axis of elongate member as 28 is shown doing and as indicated by the arrow AB in FIG. 15. The ability of intermediate attachment means to pivot in planes parallel to longitudinal axis of elongate member as well as rotate about the same axis allows the secured flap attachment means the ability to rotate about multiple axes relative to the longitudinal axis of elongate member. Also, even though it is not shown it should be noted that the intermediate attachment means could be secured their respective bearings and consequently elongate member via universal joints, or the flap attachment means could be secured to their respective peg like protuberances 24 via universal joints. Either way once flap attachment means are secured to their respective intermediate attachment means the flap attachment means would be able to rotate about any axis thereby increasing the pivotability and flexibility of the entire securement means. The elongate member is basically a telescopically extendable and retractable member and the three coaxial secondary and longitudinally slidable elongate members it comprises which are 30*a*, 30*c*, and 30*b* have successively larger transaxial diameters respectively. Focusing on FIG. 13 and with regards to 30*a* and 30*c*, the larger diametered of the two which is 30*c* has a uniform bore 36, and an opening 38 in one of its ends leading to bore 36 where 38 is wide enough to allow the shaft of the smaller diametered of the two 30*a* to just slide in and out of 38 and into and out of bore 36. The terminal conjugating end 42*a* of smaller diametered secondary elongate member 30*a* has a diameter larger than that of the rest of the shaft of 30*a* which prevents it from exiting opening 38 and as such 42*a* is slidably confined within bore 36. Encasing the conjugating ends 42*a* and 42*c* and proximal connected shaft portions 30*a* and 30*c* respectively is secondary elongate member 30*b*. Member 30*b* can be described as a hollow cylinder of uniform bore 45 with coaxial entrances 43 and 44 located on either end leading to bore 45. The diameter of entrance 43 is smaller than that of 44, and the diameter of both 43 and 44 are smaller than that of bore 45. The diameter of the entrance 43 is wide enough to allow the shaft of the smaller diametered secondary elongate member 30*a* to just longitudinally slide through, and the diameter of entrance 44 is wide enough to allow the shaft of the larger diametered elongate member 30*c* to just longitudinally slide through. Sections of the shaft of 30*c* at the conjugating end 42*c* and again a little distance away at 46 have outer diameters that are wider than that of the rest of shaft 40*b* and are wide enough so that 40*b* is able to just slide longitudinally within bore 45 but not completely exit bore. Thus the conjugating end 42*c* of secondary elongate member 30*c* and a proximal connected portion of shaft is slidably confined to within bore 45.

Description of Operation

Figure 2:
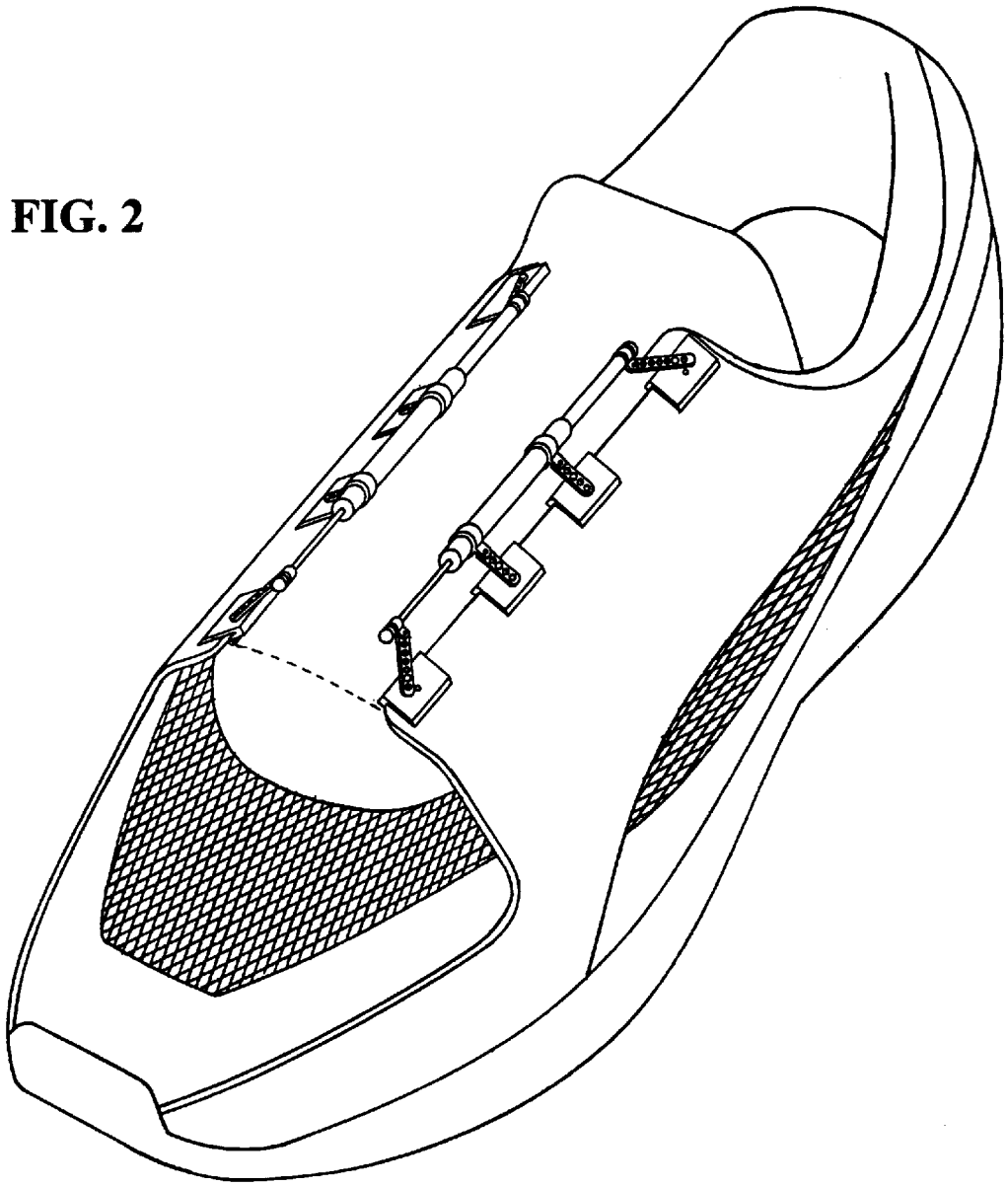
FIG. 2 is an isometric view of the symmetrical pair of first embodiment of securement means secured to a shoe.
Figure 3:
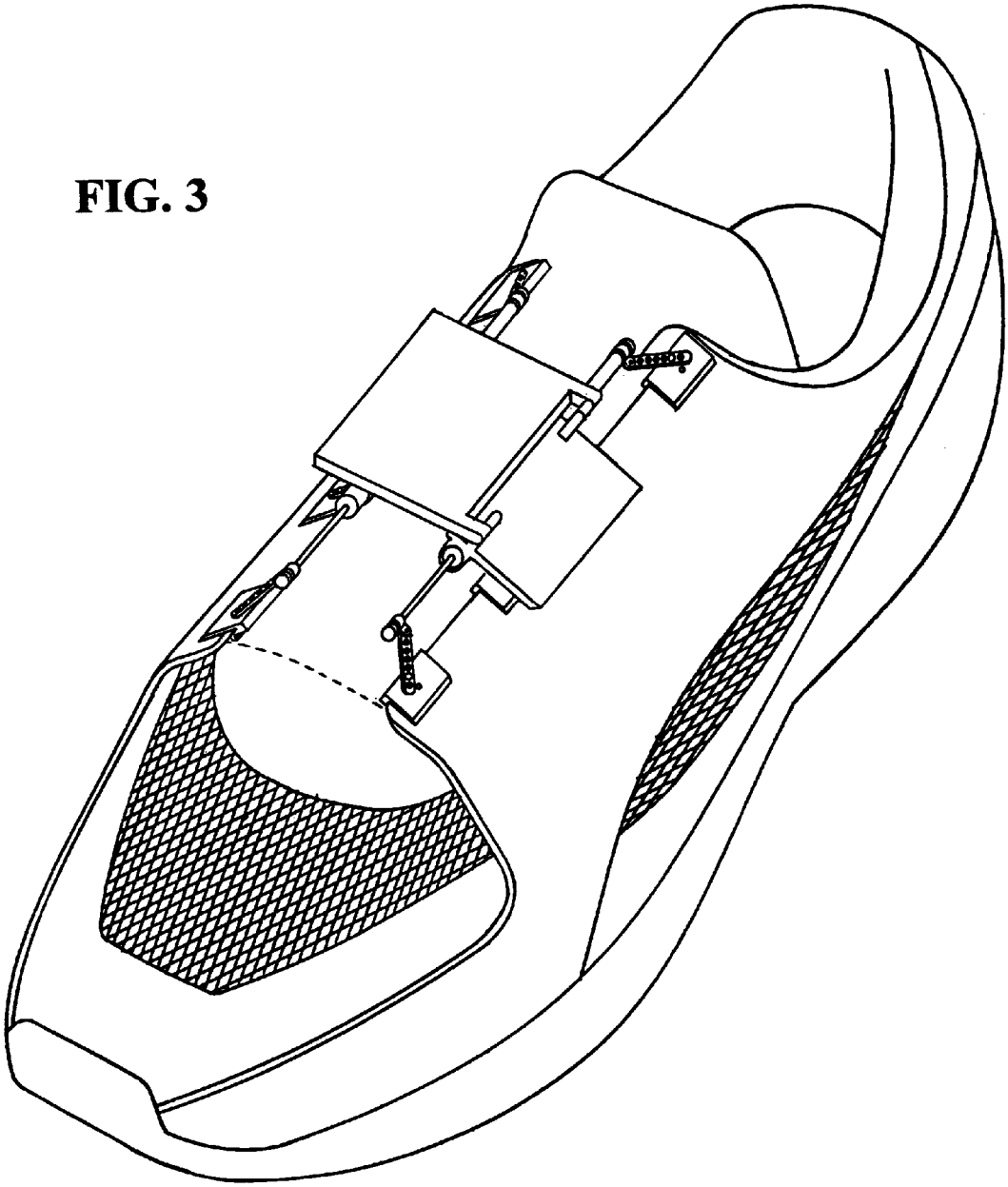
FIGS. 3 and 4 are isometric views of the symmetrical pair of first embodiment of securement means incorporated into shoe fastening devices with each device secured to a shoe.
Figure 4:
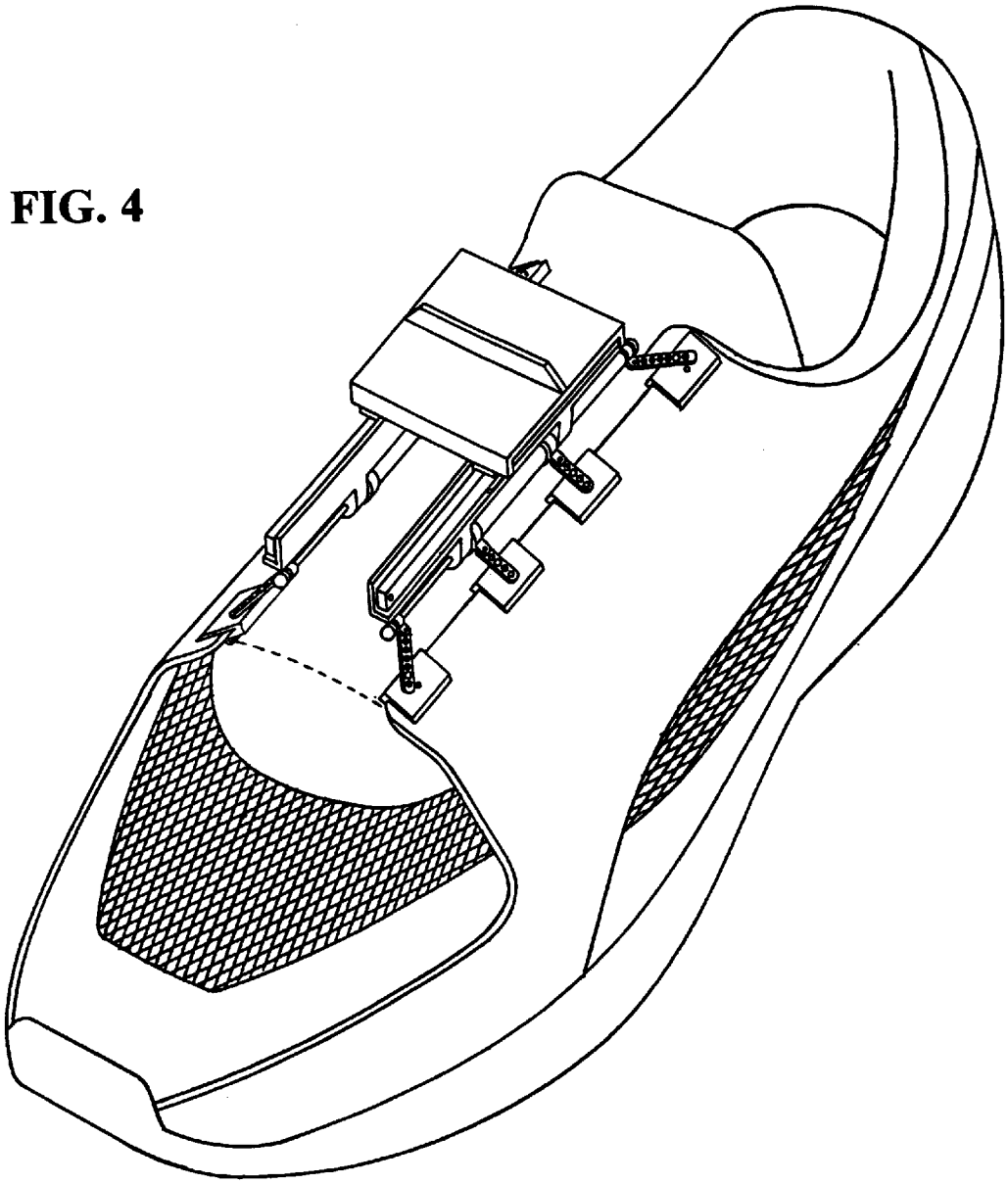
Figure 26:
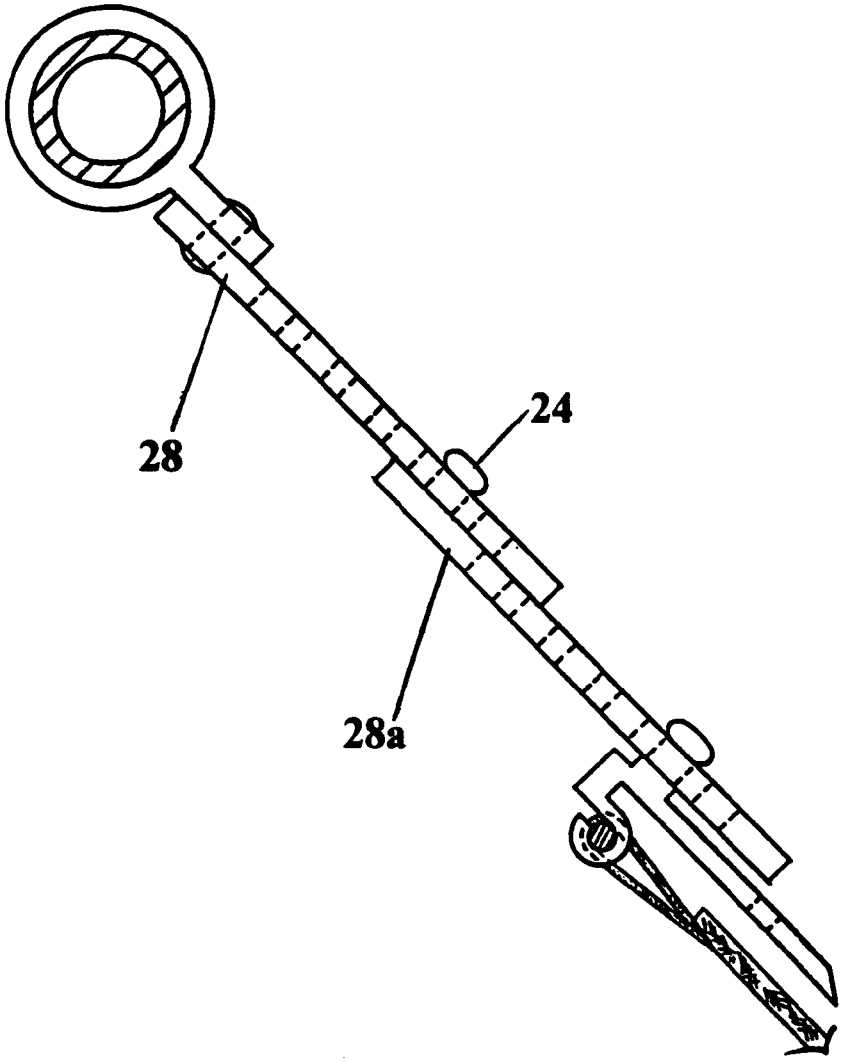

With reference to FIGS. 1 through 4 the longitudinally extendable elongate member is lined up with the flap to which it is to be secured and extended or retracted so that when the two bearings 32*a* and 32*d* located closest to its extremities are slid towards the extremities of their respective secondary elongate members 30*a* and 30*c* one of the respective flap attachment means 1*d* accesses the topmost eyelet, or loop of flap depending on the mode of securement. The other respective flap attachment means 1 a accesses the bottommost eyelet, or loop of flap, again depending on the mode of securement. The two flap attachment means in the middle 1*b* and 1*c* are adjusted so that all the flap attachment means are as evenly spaced apart as possible so as to evenly disperse any lateral fastening force effected from a device employing use of securement means through securement means to flap, like the devices in FIGS. 3 and 4. There are two methods of securing the flap attachment means of this embodiment to flap. The first method of securement seen in FIGS. 7, 8, and 9 engages the eyelet formed in flap. Member 2 is placed on the outer surface 48*a*, seen clearly in FIG. 9 of flap 48 so that opening 10 is directly over and lined up with corresponding eyelet 50. Member 4 is positioned over on the opposite surface 48*b* of flap 48 and its peg like eyelet engagement means 14 is inserted through eyelet 50 and subsequently through opening 10 so that its terminal end 14*a* of 14 completely issues through 10 whereby 14 securely engages 10 and consequently engages 2 while confining a portion of flap 48 between planar surfaces 6 and 12 and mutually securing flap 48 and flap attachment means to each other. The second method of securement seen in FIGS. 10, 11, and 12 engages the loops designed for laces and secured to flap. Secured to flap 52 is loop 54. Loop engagement means 20 is inserted in a longitudinal manner through loop 54 so that one of its two end shaft portions juts out on each side of loop 54. With the end shaft portions of 20 jutting out member 2 is positioned alongside loop 54 so that each of the slots 22*a* and 22*b* is positioned directly below and lined up with one of said end shaft portions of 20. Member 2 is then directed upwards with steady force so that each jutting end shaft portion of 20 instantaneously enters into and exits a respective slot subsequently securely coming to rest in throughbore 18. This engagement of loop engagement means 20 and member 2 completes a closed circuit within which loop 54, and consequently to which flap 52, is secured. With flap attachment means secured to flap any lateral fastening force that originates from, or passes through elongate member will be transmitted through flap attachment means and subsequently to flap. The elongate member could either be connected to a part of a shoe fastening device from which lateral fastening force originates or seems to originate like with my patent application Ser. No. 09/206,122 as illustrated in FIG. 4 or could itself be integrated into a shoe fastening device so as to be an integral part of the device like with my patent application Ser. No. 09/126,478 as seen in FIG. 3. FIG. 4 shows elongate member secured to fastening device above it and FIG. 3 shows secondary elongate member 30*b* serving as an axle about which an actuating lever can pivot. FIG. 2 shows the first embodiment of securement means without an incorporated shoe fastening device secured to shoe for clarity. The position of the flap attachment means along the respective intermediate attachment means 28 to which they are connected can be adjusted. This is done by detaching peg like protuberance 24, seen in FIGS. 6 and 14 from its current opening 26 and securing it to another opening 26' on the same intermediate attachment means thereby adjusting or varying the longitudinal positioning of flap attachment means along its respective intermediate attachment means and consequently varying the perpendicular displacement between elongate member and flap to which it is indirectly secured. Another way of adjusting the perpendicular displacement between a flap attachment means and elongate member is to pivot the intermediate attachment means to which flap attachment means is secured towards elongate member as shown in FIG. 15. Either way of adjusting the perpendicular displacement between flap attachment means and elongate member can be employed and they can both be used in combination. The flap attachment means are secured to the intermediate attachment means in a way that the alignment of the elongated members in relation to the flaps allows the device incorporating use of the securement means to operate efficiently and in the manner intended. For example in FIGS. 3 and 4 for the fastening devices shown to work efficiently and in the manner intended the elongate members secured to either flap of their respective shoes should ideally be parallel to the longitudinal medians of their respective shoes regardless of if the flaps themselves are parallel to said longitudinal medians or to each other, and to that end the connections of flap attachment means to their respective intermediate attachment means as well as the pivotal positioning of intermediate attachment means are adjusted to achieve this. Also even though not shown in the first embodiment of the securement means, for a shoe whose flaps deviate substantially from the longitudinal median of said shoe the intermediate attachment means in FIG. 26 comprising two similar and connectable members 28 and 28*a* can be used. Member 28*a* has a peg like protuberance 24 which can fit into any of the openings in member 28 which are similar to the openings in 28*a*, thereby connecting 28*a* to 28 in the cascade arrangement shown. Even though the loop engagement flap attachment means is shown secured to 28*a*, any of the previously described flap attachment means can be employed. Use of two or more members in the intermediate attachment means extends its reach. Although not shown in any of the figures the intermediate attachment means could also be made longitudinally extendable by comprising two longitudinally slidable elongate members.

Description of Alternative Embodiment of Flap Attachment Mechanism

A alternative flap attachment means shown in FIGS. 16, 17, 18, and 19 comprises three planar segments 58, 60 and 62 each fundamentally rectangular in shape. Two of the planar segments 60 and 62 are secured to the base of, and laterally fixed apart via, an interim piece 64 which is fundamentally a cuboid integrated with, and forming one unit with 60 and 62 and other planar segment 58 and whose two largest outer and opposing surfaces 64*a* and 64*b* line up flush with the outer surfaces 60*b* and 62*b* of planar segments 60 and 62 respectively. Although fixed apart 60 and 62 are within proximity of each other and each has a planar surface 60*a* and 62*a* facing the other. The top edge of planar segment 58 is hinged at the base of 64 on surface 64*a* which is integrated with the top edge of 60 whereby allowing 58 to swing towards and away from 60 as indicated by the arrow CD. Appendaged to the inner surface 58*a* of planar segment 58 is a peg like flap pinning means 66 with a cylindrical shaft 66*b* and the terminal end 66*a* of which is cone shaped with a base diameter slightly larger than that of the rest of the shaft and a conical height measuring almost the same distance as that between 60 and 62. An opening 60*c* whose diameter is wide enough to allow the shaft 66*b* of 66 to just fit is located through the cross-section of 60 and exists to engage 66. However due to its larger diameter 66*a* cannot easily fit into 60*c* and does so only when instantaneously passing through 60*c* which is achieved by the application of a steady compressing or separating force resulting in a snapped engagement or detachment respectively of 66 with 60*c*. Secured to the surface 64*a* of member 64 is a peg like protuberance 24 which is identical in form and function to the one located on the flap attachment mechanism shown in FIGS. 6, 9, 12, and 14 and described in the first embodiment, and as such the present flap attachment means can replace any of the flap attachment means described in the first embodiment.

Description of Operation of Alternative Embodiment of Flap Attachment Means

This alternative embodiment of flap attachment means achieves securement by pinning flap 68 to flap attachment means. With the hinged planar segment member 58 rotated away from member 60 as indicated by the dotted line in FIG. 16 the cross-section of flap 68 to which flap attachment means is to be secured is inserted between 60 and 62 so that the top of flap portion is inserted past the opening 60*c*. With portion of flap now inserted member 58 is rotated towards member 60 so that the terminal end 66*a* of the peg like flap pinning means 66 completely issues through opening 60*c* whereby 66 securely engages 60*c*. The terminal end 66*a* of 66 now occupies space previously occupied by a portion of flap 68 and presses into the pliable fabric of the portion of flap it comes into contact with in effect pinning portion of flap against the inner surface 62*a* of member 62.

Description of Other Embodiment of Flap Attachment Means

Figure 20:
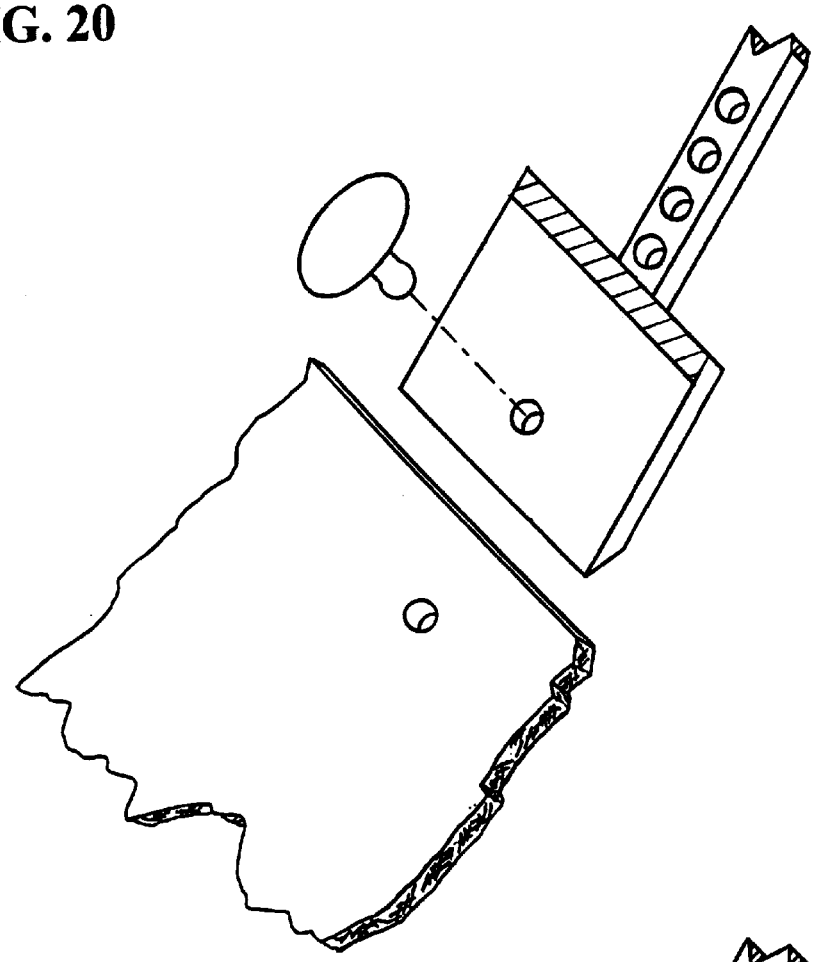
FIG. 20 shows the flap attachment means in FIGS. 7,etc but with the support means 16*a* and 16*b* and interim portion 7 for the loop engagement means removed.

FIG. 20 shows the flap attachment means of FIG. 7 but with the support means 16*a* and 16*b* and interim portion 7 for the loop engagement means removed. This is done to illustrate how a flap attachment means designed for securement to flap by the eyelet engagement method only might look. Like FIG. 7 this flap attachment means is shown secured to the intermediate attachment means of the preferred embodiment of the securement means.

Figure 21:
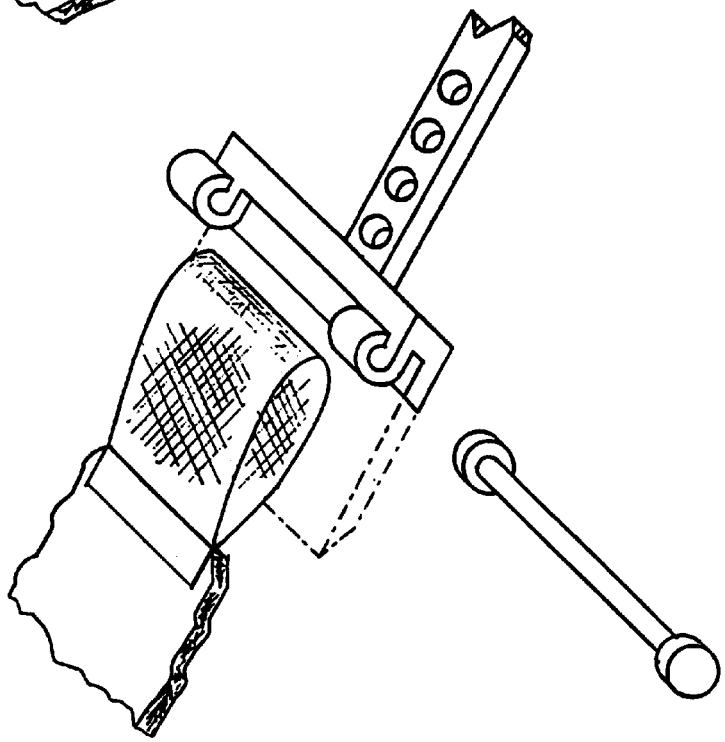
FIGS. 21, 22 and 23 show the flap attachment means of FIGS. 10 and 12 respectively but with most of the lower portion of planar member 2 removed.
Figure 22:
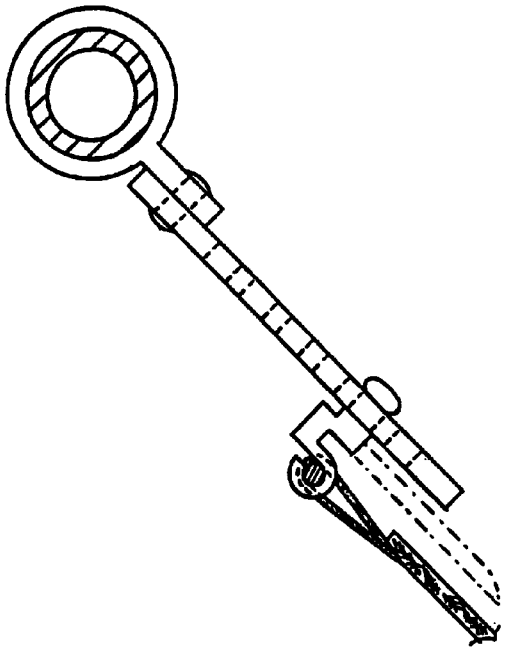

FIGS. 21 and 22 show the flap attachment means of FIGS. 10 and 12 respectively but with most of the lower planar portion of 2 removed to illustrate how a flap attachment means designed for securement to flap by the loop engagement method only might look.

Figure 23:
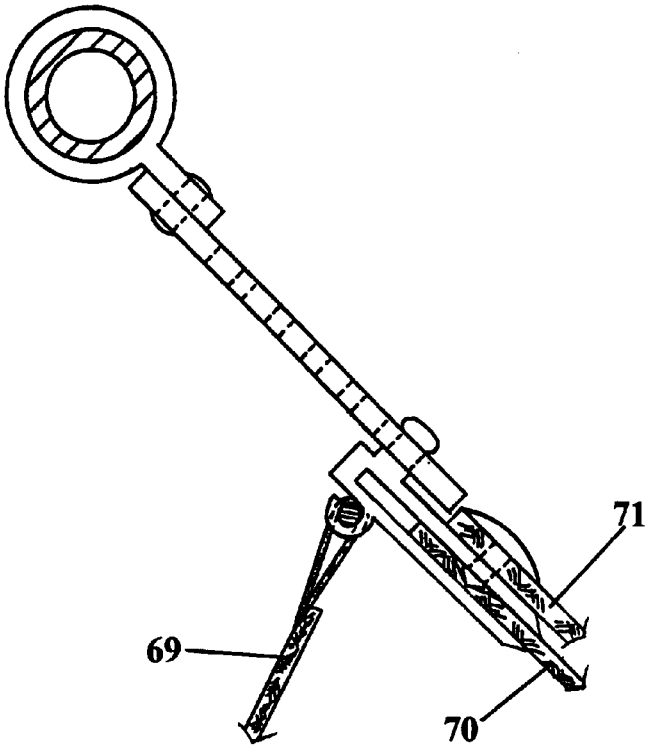

FIG. 23 shows a flap attachment means combining the features of all three previously described methods. The loop engagement method is used on flap 69. The pinning method for flap 70. And the eyelet engagement method for flap 71. Even though three flaps are shown secured to the flap attachment means in the illustration, it is to be understood that in practice only one flap portion at any one time and by any one of the said methods would be secured to the flap attachment means.

Description of Other Embodiments of Security Mechanism

Figure 24:
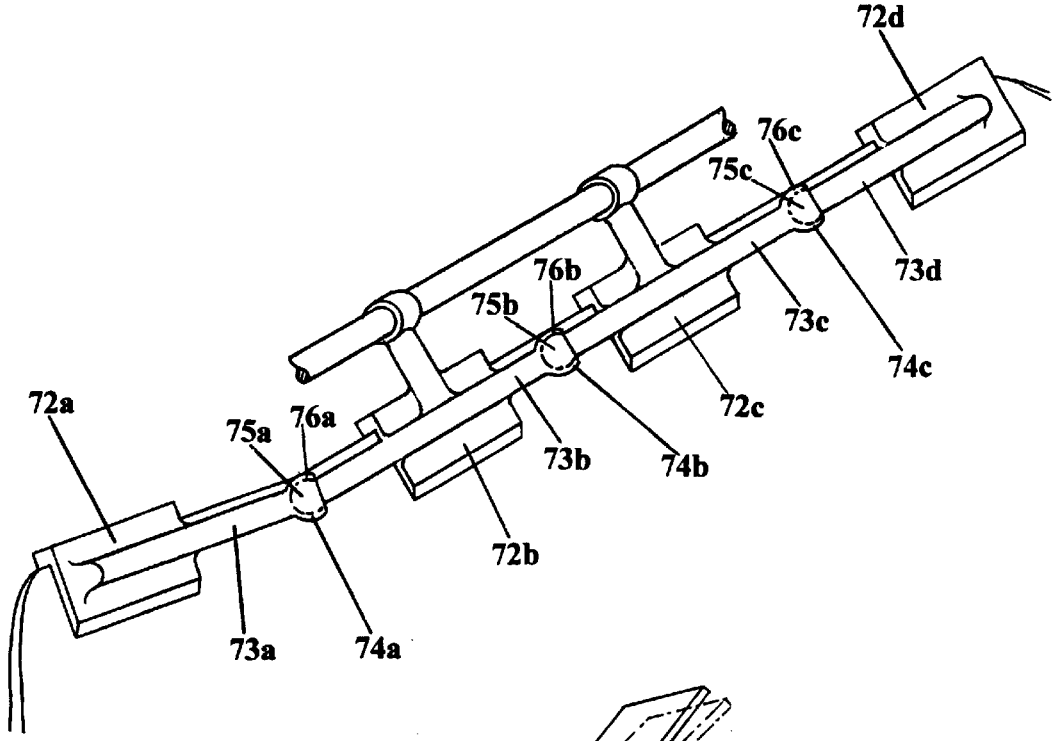
FIG. 24 shows a second embodiment of securement means with a pivotably segmented elongate member.

FIG. 24 shows a second version the securement means where the flap attachment means 72*a*, 72*b*, 72*c*, and 72*d* are secured to an elongate member comprising shorter secondary pivotable elongate segments 73*a*, 73*b*, 73*c*, and 73*d* where each of the segments is pivotably secured to another in a substantially linear sequence at joints 74*a*, 74*b* and 74*c*. Even though not shown incorporated into a shoe fastening device the elongate member can either be an integral working part of a shoe fastening device in a manner similar to the elongate member in FIG. 3 or be secured to a part of device via intermediate attachment means in a manner similar to the elongate member in FIG. 4. In this version the flap attachment means can be secured to their respective flap in any of the three previously described methods. However any method except the flap pinning method would be impractical since the spacing between successive peg like eyelet engagement means or support means for loop engagement means are set and may not necessarily match the spacing between eyelets or loops of any particular shoe. The way to resolve this is to make each pivotable segment longitudinally extendable or retractable by means previously described in this specification or otherwise.

This version is also longitudinally extendable or contractable by virtue of the means of connection securing each pivotable segment to another. The pivotable means of connection shown consists of series of ball connecting ends 75*a*, 75*b*, 75*c* indicated by the dotted lines, and socket connecting ends 76*a*, 76*b*, and 76*c* where assuming securement means is made of resilient material the ball connecting ends 75*a*, 75*b*, and 75*c* fit into the openings of the socket connecting ends 76*a*, 76*b*, and 76*c* respectively only when instantaneously passing through said openings which is achieved by the application of a steady compressing or separating force resulting in a snapped engagement or detachment of said ball connecting ends with said socket connecting ends. In the securement means shown in FIG. 24 starting off with the two inner flap attachment means 72*b* and 72*c* a user wanting to extend the securement means so as to secure it to more flap just has to engage ball 75*a* and socket 76*a* and ball 75*c* and socket 76*c* and secure the flap attachment means to the flaps consequently longitudinally extending securement means and length of flap to which said means is secured to. It should be pointed out that extending elongate member by the subsequent attachment of shorter secondary members can be achieved by other connecting means employing use of interfitting, coupling, conjugating, and any other type of interconnecting means found on said secondary members.

It is also worth noting that if the device in FIG. 24 is intended to be "as is" and is not longitudinally extendable or contractable then the flap attachment means can be permanently secured to flap by any method such as adhesive bonding, fasteners etc, and any of the flap attachment means as a whole can comprise at least one substantially planar surface with a substantial portion thereof in contact with flap to which it is permanently secured, shown.

Figure 25:
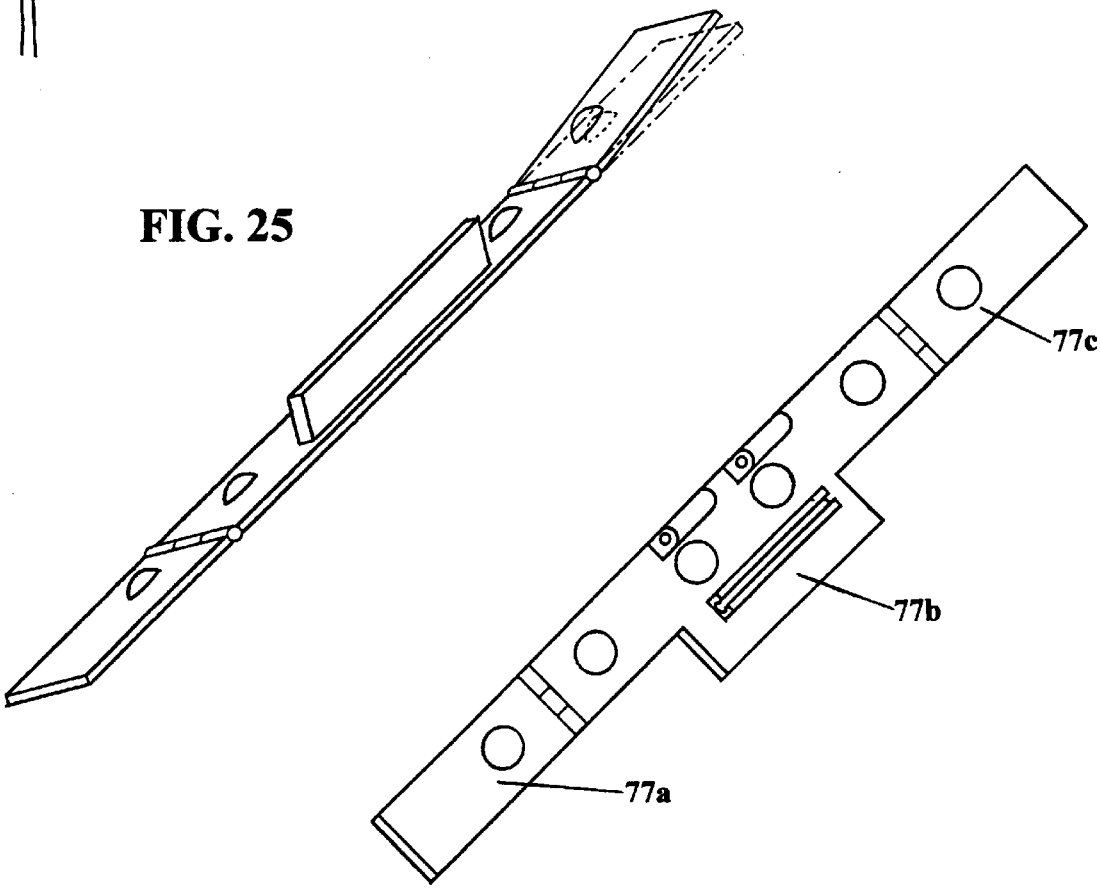
FIG. 25 shows a pair of a third embodiment of securement means comprising flap attachment means each pivotably secured to another in linear sequence.

FIG. 25 shows a third version of a pair of securement means each for connecting to one of the dual opposing flaps of a shoe in a manner similar to the pair of securement means shown in FIGS. 1 and 2 and each containing connecting parts for a shoe fastening device such as my patent application Ser. No. 09/126,478. Assuming both securement means are symmetrical with the exceptions being the connecting parts for a shoe fastening device, focus can be given to the securement means on the right comprising segments 77*a*, 77*b*, and 77*c*. Each of these segments is pivotably secured to another in a substantially linear sequence. In this version just as above a practical flap attachment means would be the one employing use of the flap pinning method, but since securement means is not longitudinally extendable and contractable, and like explained above any method of permanent securement such as adhesive bonding or as shown in the figure employing the use of fasteners would be appropriate. To this end the flap attachment means exists fundamentally as planar segments with downward facing substantially planar surfaces which would be substantially in contact with the flaps to which they are secured.

Figure 5:
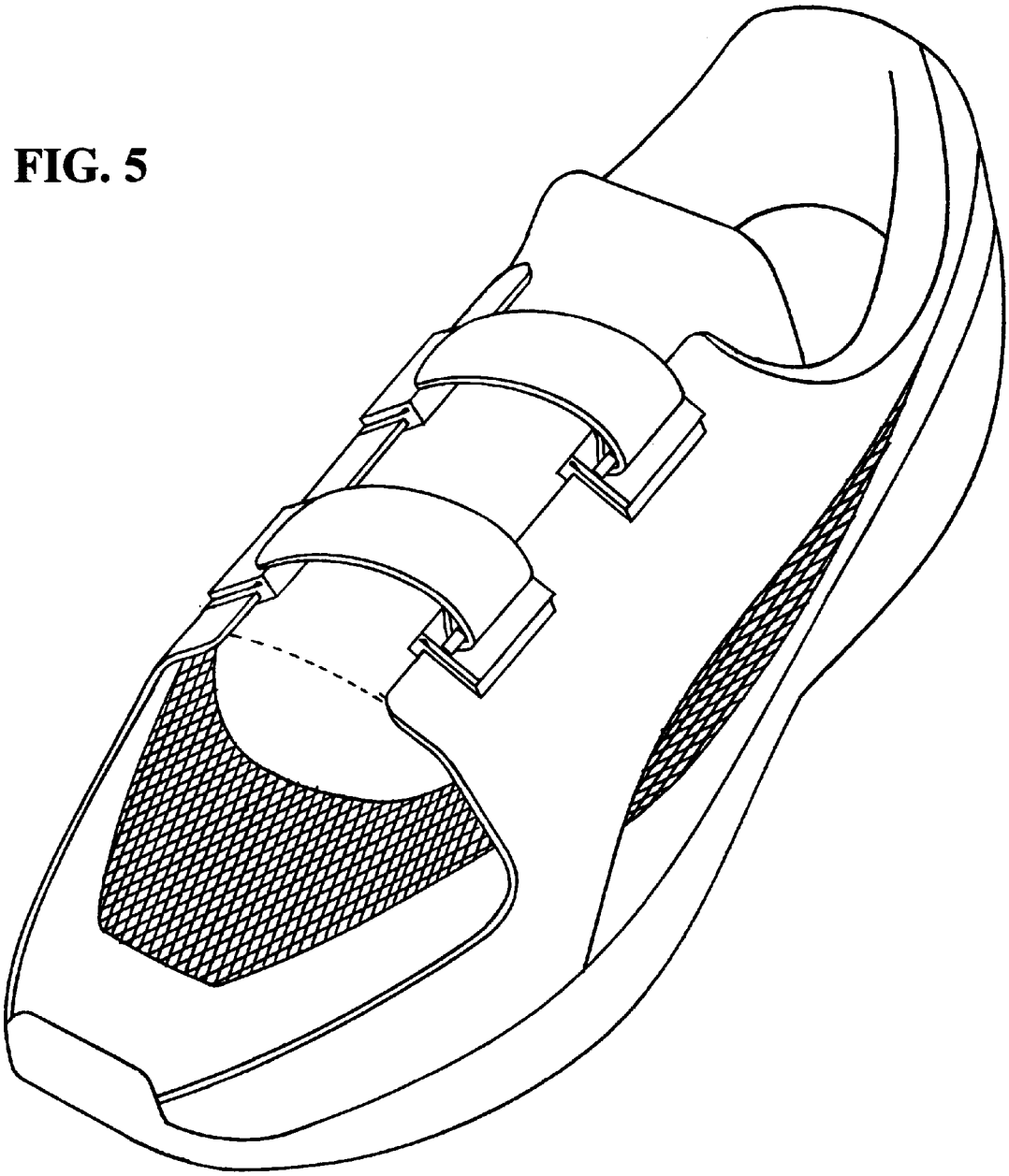
FIG. 5 shows strap fasteners using the flap attachment means which are used in plurality in the first embodiment of securement means.
Figure 8:
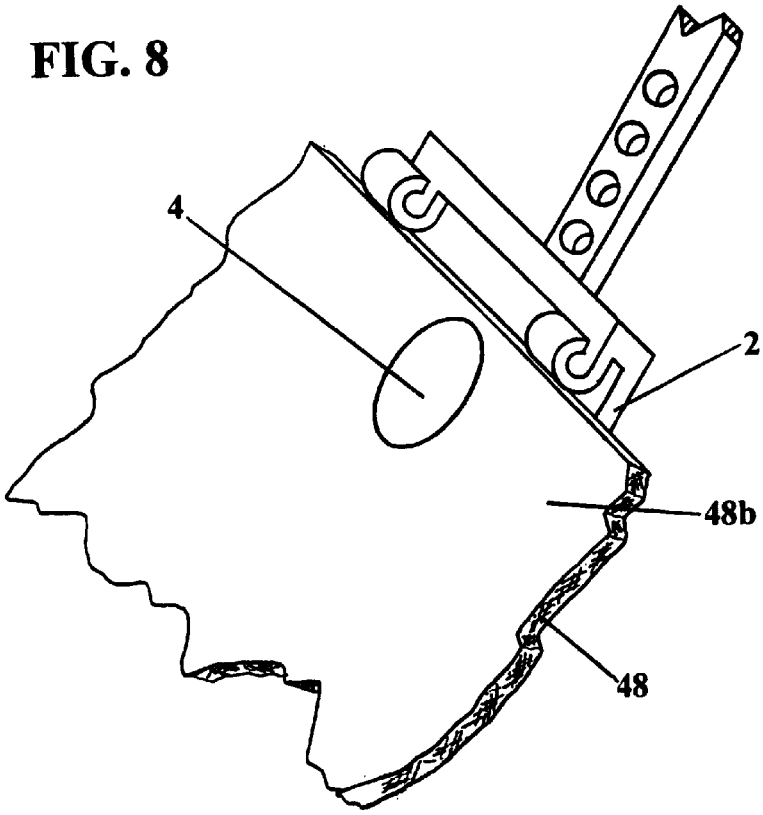

FIG. 5 shows straps fasteners secured to a shoe via flap attachment means using the flap pinning method but which could also be fastened to shoe by the eyelet or loop engagement methods depending on whether the shoe has eyelets or loops respectively. Due to the nature of the strap fastening means shown and their similarity to laces in that the straps are not only pliable but relatively narrow in relation to the length of the flap to which they are secured only one flap attachment means per strap is required to secure a strap to a portion of flap of shoe and thus flexibility is maintained once shoe is fastened.

Pursuant to the above I claim:

1. A means to secure a device to flap of shoe employing use of said device whereby said means comprises a first flap attachment means comprising two substantially planar surfaces with an opening located in one of said planar surfaces and, a peg like eyelet engagement means for securely engaging said opening located on other surface, and where said first flap attachment means is securable to said device and, a second flap attachment means combined with said first flap attachment means comprising a loop engagement means said loop engagement means defining at least two ends securable to a support means and, a support means for supporting said loop engagement means, and whereby upon securement of said two ends with said support means a closed circuit is formed and, where said second flap attachment means is securable to said device and, a third flap attachment means combined with said first and said second flap attachment means comprising two substantially planar surfaces proximally set apart at a fixed distance whereby the two substantially planar surfaces are facing and substantially parallel to each other, and where at least one opening exists in one of the two substantially planar surfaces and, at least one corresponding peg like flap pinning means protruding from a third surface to securely engage said opening and, where said secure engagement of said flap pinning means and said opening occurs when terminal end of peg like flap pinning means is between said two proximally set apart surfaces, and where said third flap attachment means is securable to said device.

2. A means to secure a device to flap of shoe employing use of said device whereby said means comprises any of the arrangements of the flap attachment means of claim 1 and where said arrangements include any of the flap attachment means of claim 1 or all combinations thereof comprising any two or all three of said flap attachment means.

3. A means for securing a device to flap of shoe employing use of said device comprising a plurality of the flap attachment means of claim 2 secured to an elongate member whereby said elongate member is securable to said device, and where for present purposes an elongate member is defined as any member in which a longitudinal axis long enough to allow at least two flap attachment means to be secured to said member in linear sequence can be defined.

4. The securement means of claim 3 where said flap attachment means are slidable along longitudinal axis of said elongate member.

5. The securement means of claim 3 where said flap attachment means are pivotably secured to said elongate member.

6. The securement means of claim 3 where said elongate member is longitudinally extendable and retractable.

7. The securement means of claim 3 where said elongate member comprises shorter pivotable segments each secured to another in linear sequence.

8. The securement means of claim 5 where flap attachment means comprise at least one substantially planar surface with a substantial portion thereof in contact with and secured to said flap by any method of securement.

9. The securement means of claim 7 where flap attachment means comprise at least one substantially planar surface with a substantial portion thereof in contact with and secured to said flap by any method of securement.

10. A means for securing a shoe fastening device to flap of shoe employing use of said device comprising a plurality of the flap attachment means of claim 2 whereby each of said flap attachment means is pivotably secured to another in linear sequence, and where at least one of said attachment means is securable to said device.

11. The securement means of claim 10 where said flap attachment means comprise at least one substantially planar surface with a substantial portion thereof in contact with and secured to said flap by any method of securement.

12. The securement means of claim 5 where said flap attachment means are each securable to a respective intermediate attachment means and where said intermediate attachment means are securable to elongate member and where said flap attachment means can be repositioned along intermediate attachment means.

13. The securement means of claim 6 where said elongate member comprises at least two longitudinally slidable members.

14. The securement means of claim 6 where said elongate member comprises at least two secondary elongate members and where each secondary member has at least one connective portion securely engageable with and detachable from a corresponding connective portion of another secondary member.

15. The securement means of claim 12 where securement of said flap attachment means to said respective intermediate attachment means is pivotable.

16. The securement means of claim 12 where securement of said intermediate attachment means to said elongate member is pivotable.

17. The securement means of claim 12 where said intermediate attachment means are longitudinally extendable.

* * * * *